US006561004B1

(12) United States Patent
Neiner et al.

(10) Patent No.: US 6,561,004 B1
(45) Date of Patent: May 13, 2003

(54) CAN LID CLOSURE AND METHOD OF JOINING A CAN LID CLOSURE TO A CAN BODY

(75) Inventors: Christopher G. Neiner, Defiance, MO (US); James Reed, Ballwyn, MO (US)

(73) Assignee: Metal Container Corporation, St. Louis, MO (US)

( * ) Notice: Subject to any disclaimer, the term of this patent is extended or adjusted under 35 U.S.C. 154(b) by 0 days.

(21) Appl. No.: 09/724,637

(22) Filed: Nov. 28, 2000

Related U.S. Application Data

(63) Continuation-in-part of application No. 09/456,345, filed on Dec. 8, 1999.

(51) Int. Cl.[7] ..... B21D 51/26

(52) U.S. Cl. ..... 72/715; 413/2; 413/4; 413/6; 413/8; 413/27; 413/31

(58) Field of Search ..... 413/2, 4, 6, 8, 413/27, 31, 74; 72/715

(56) References Cited

U.S. PATENT DOCUMENTS

| | | | | | |
|---|---|---|---|---|---|
| 3,843,014 | A | | 10/1974 | Cospen | |
| 3,983,827 | A | | 10/1976 | Meadors | 113/121 |
| 4,037,550 | A | * | 7/1977 | Zofko | 220/614 |
| 4,093,102 | A | * | 6/1978 | Kraska | 220/623 |
| 4,213,324 | A | * | 7/1980 | Kelley et al. | 413/15 |
| 4,215,795 | A | * | 8/1980 | Elser | 220/276 |
| 4,217,843 | A | * | 8/1980 | Kraska | 413/12 |
| 4,271,778 | A | * | 6/1981 | Le Bret | 220/619 |
| 4,448,322 | A | * | 5/1984 | Kraska | 220/623 |
| 4,578,007 | A | * | 3/1986 | Diekhoff | 413/31 |
| 4,606,472 | A | | 8/1986 | Taube | |
| 4,641,761 | A | * | 2/1987 | Smith et al. | 220/623 |
| 4,674,649 | A | | 6/1987 | Pavely | |
| 4,735,863 | A | * | 4/1988 | Bachmann et al. | 220/619 |
| 4,808,052 | A | * | 2/1989 | Bulso et al. | 413/56 |
| 4,809,861 | A | | 3/1989 | Wilkinson | |
| 4,823,973 | A | | 4/1989 | Jewitt et al. | 220/67 |
| 4,893,725 | A | | 1/1990 | Ball | |
| 5,027,580 | A | * | 7/1991 | Hymes et al. | 413/27 |
| 5,066,184 | A | * | 11/1991 | Taura et al. | 413/4 |
| 5,320,469 | A | * | 6/1994 | Katou et al. | 413/27 |
| 5,582,319 | A | * | 12/1996 | Heyes et al. | 156/308.2 |
| 5,911,551 | A | * | 6/1999 | Moran | 413/31 |
| 5,969,605 | A | * | 10/1999 | McIntyre et al. | 209/549 |
| 6,126,034 | A | * | 10/2000 | Borden et al. | 206/509 |

FOREIGN PATENT DOCUMENTS

| | | |
|---|---|---|
| DE | 92 11 788.0 | 2/1993 |
| EP | 0 139 282 A2 | 5/1985 |
| EP | 0 340 955 B1 | 11/1989 |
| EP | 0 340 955 A1 | 11/1989 |
| GB | 2 196 891 A | 5/1988 |
| GB | 2 315 478 A | 2/1998 |
| JP | 5 185170 | 7/1993 |

OTHER PUBLICATIONS

JP S57–117323; Japanese Utility Model Application; Jan. 12, 1981; Toyo Seikan, Co. Ltd.
WO 00/12243; International Application Published by the World Intellectual Property Organization; Mar. 9, 2000; PCT/US99/18944; Crown Cork & Seal Technologies Corporation; United States.

* cited by examiner

*Primary Examiner*—William Hong
(74) *Attorney, Agent, or Firm*—Dawn C. Wolff; Storm & Hemingway, L.L.P.

(57) ABSTRACT

A preferred embodiment of the disclosed can lid has a center panel having a central axis that is perpendicular to a diameter of the outer rim, or peripheral curl portion, of the can lid, an annular countersink surrounding the center panel, an arcuate portion extending radially outward from the annular countersink, a step portion extending radially upward and outward from the arcuate portion, a first transitional portion extending radially outward from the step portion, a second transitional portion extending radially outward and upward from the first transitional portion, and a peripheral curl portion extending outwardly from the second transitional portion.

6 Claims, 7 Drawing Sheets

CAN LID CLOSURE AND METHOD OF JOINING A CAN LID CLOSURE TO A CAN BODY

CROSS-REFERENCE TO RELATED APPLICATION

This application is a continuation-in-part of pending U.S. patent application Ser. No. 09/456,345, entitled "CAN LID CLOSURE AND METHOD OF JOINING A CAN LID CLOSURE TO A CAN BODY," filed on Dec. 8, 1999, for inventor Christopher G. Neiner.

TECHNICAL FIELD

The present invention relates generally to metal containers, and more particularly to metal cans.

BACKGROUND OF THE INVENTION

Aluminum cans are used primarily as containers for retail sale of beverages in individual portions. Annual sales of such cans are in the billions and consequently, over the years, their design has been refined to reduce cost and improve performance. Other refinements have been made for ecological purposes, to improve reclamation and promote recycling.

Cost reductions may be realized in material savings, scrap reduction and improved production rates. Performance improvements may be functional in nature, such as better sealing and higher ultimate pressure capacity. Such improvements can allow the use of thinner sheet metal, which leads directly to material cost reductions. Performance improvements may also be ergonomic in nature, such as a can end configured to allow for easier pull tab access or better lip contact.

Aluminum cans are usually formed from a precoated aluminum alloy, such as the aluminum alloy 5182. The cans, which are typically made from relatively thin sheet metal, must be capable of withstanding pressures approaching 100 psi, with 90 psi being an industry recognized requirement. The cans are usually formed from a can body to which is joined a can lid or closure. Each of these components has certain specifications and requirements. For instance, the upper surface of the can lids must be configured to nest with the lower surface of the can bottoms so that the cans can be easily stacked one on top of the other. It is also desirable to have the can lids themselves nest with each other in a stacked arrangement for handling and shipping purposes prior to attaching the can lid to the can body. The ability to satisfy these functional requirements with the use of ever less material continues to develop.

Patent Cooperation Treaty International Publication Number WO 96/37414 describes a can lid design for reduced metal usage. This can lid comprises a peripheral portion or "curl," a frustoconical chuckwall depending from the interior of the peripheral curl, an outwardly concave annular reinforcing bead or "countersink" extending radially inwards from the chuckwall, and a center panel supported by the inner portion of the countersink. The frustoconical chuckwall is inclined at an angle of between 20° and 60° with respect to an axis perpendicular to the center panel. The chuckwall connects the countersink and peripheral curl and is the portion of the lid the seaming chuck contacts during the seaming process. A double seam is formed between the can end and a can body by a process wherein the peripheral curl is centered on the can body flange by a chuck that is partially frustoconical and partially cylindrical. The frustoconical portion of the chuck is designed to contact the frustoconical chuckwall of the can lid. The overlap of the peripheral curl on the lid with the can body flange is described to be by a conventional amount. Rotation of the can lid/can body, first against a seaming roll and then a flattening roll completes a double seam between the two parts. During the flattening portion of the operation, the portion of the chuckwall adjacent to the peripheral curl is bent and flattened against the cylindrical surface of the chuck. The lid of International Publication Number WO 96/37414 incorporates known dimensions for the peripheral curl portion which is seamed to the can.

The can lid of International Publication Number WO 96/37414 is also susceptible to increased metal deformation during seaming and failure at lower pressures. U.S. Pat. No. 6,065,634 (Brifcani), describes the same can lid design as described in International Publication Number WO 96/37414.

Another Patent Cooperation Treaty International Publication, Number WO 98/34743, describes a can lid design which is a modification of the WO 96/37414 can lid wherein the chuckwall is in two parts. This can lid comprises a peripheral portion or "curl," a two-part chuckwall depending from the interior of the peripheral curl, an outwardly concave annular reinforcing bead or "countersink" extending radially inwards from the chuckwall, and a center panel supported by the inner portion of the countersink. The first part of the chuckwall is frustoconical and adjacent to the curl, and is inclined to an axis perpendicular to the central panel at an angle between 1 and 39 degrees, typically between 7 and 14 degrees. The second part of the chuckwall is frustoconical and adjacent to the reinforcing bead, and is inclined to an axis perpendicular to the central panel at an angle between 30 and 60 degrees, preferably between 40 and 45 degrees. A double seam is formed between the can end and a can body by a process wherein the peripheral curl is centered on the can body flange by a two-part chuck having frustoconical and cylindrical portions as in WO 96/37414. Rotation of the can lid/can body, first against a seaming tool and then a flattening roll completes a double seam between the two parts. During the seaming operations, the first portion of the chuckwall, adjacent to the peripheral curl, is deformed to contact the cylindrical surface of the chuck.

SUMMARY OF THE INVENTION

The present invention contemplates improved aluminum can lids with reduced aluminum usage, reduced reforming of the lid during seaming operations and an improved seam between the lid and the can body. A preferred embodiment of the disclosed can lid has a center panel having a central axis that is perpendicular to a diameter of the outer rim of the can lid, an annular countersink extending radially outward from the center panel, an arcuate portion extending radially outward and upward from the annular countersink, a step portion extending radially outward and upward from the arcuate portion, a first transitional portion extending radially outward and upward from the step portion, a second transitional portion extending radially outward from the first transitional portion, and a peripheral curl extending radially outward from the second transitional portion. The preferred embodiment is adapted for use with a seaming chuck having an upper frustoconical drive portion, a recessed portion, and a lower drive portion.

BRIEF DESCRIPTION OF THE DRAWINGS

The accompanying drawings are incorporated into and form a part of the specification to assist in explaining the present invention. The drawings are intended for illustrative purposes only and are not intended as exact representations of the embodiments of the present invention. The drawings further illustrate preferred examples of how the invention can be made and used and are not to be construed as limiting the invention to only those examples illustrated and described. The various advantages and features of the present invention will be apparent from a consideration of the drawings in which.

DETAILED DESCRIPTION OF THE DRAWINGS

Figure 1:
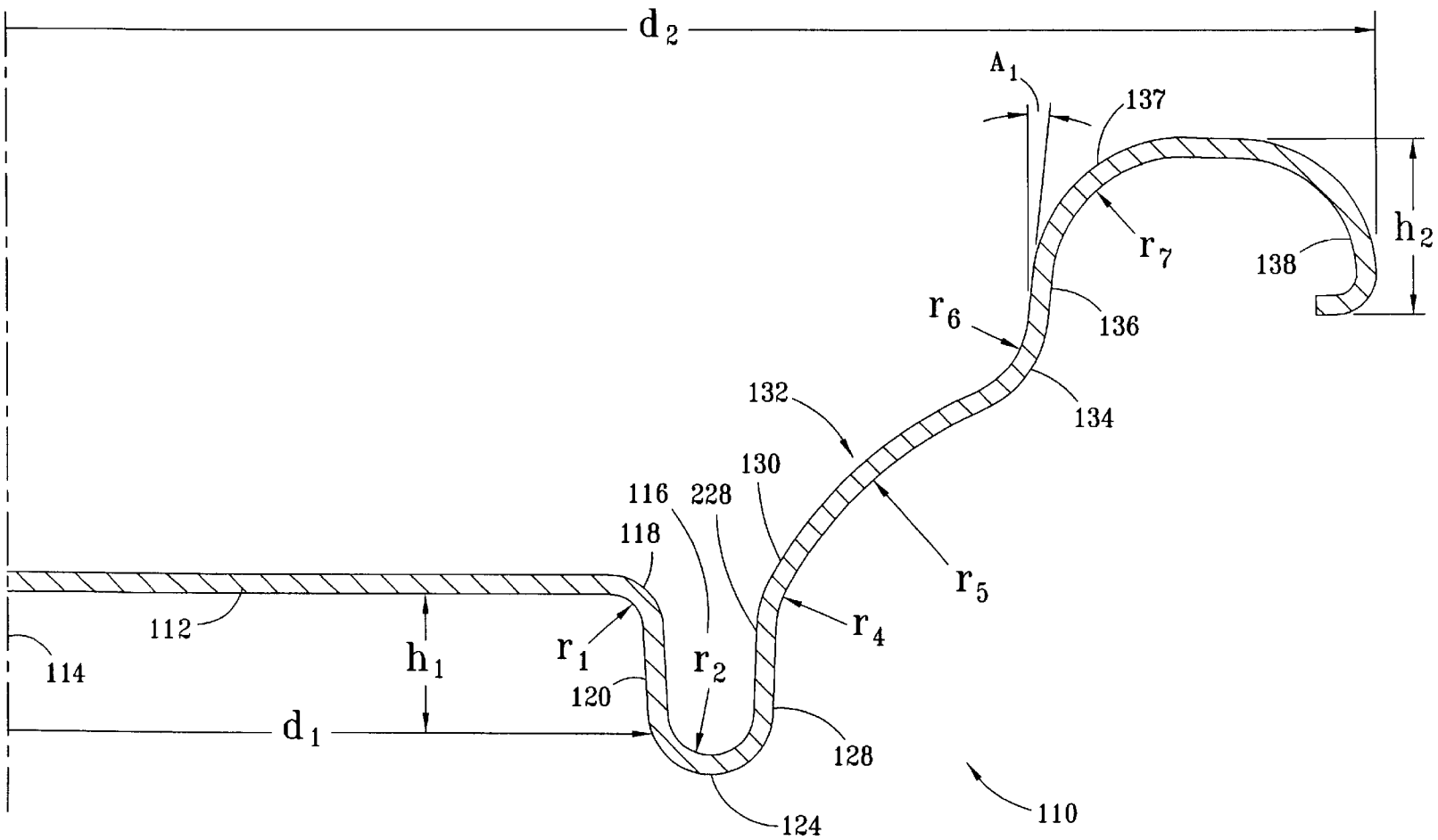
FIG. 1 shows an elevational cross-sectional view of a portion of a can lid constructed in accordance with the invention.

The present invention is described in the following text by reference to drawings of examples of how the invention can be made and used. The drawings are for illustrative purposes only and are not necessarily exact scale representations of the embodiments of the present invention. In these drawings, the same reference characters are used throughout the views to indicate like or corresponding parts. The embodiments shown and described herein are exemplary. Many details are well known in the art, and as such are neither shown nor described. It is not claimed that all of the details, parts, elements, or steps described and shown were invented herein. Even though numerous characteristics and advantages of the present invention have been described in the drawings and accompanying text, the description is illustrative only, and changes may be made, especially in matters of arrangement, shape and size of the parts, within the principles of the invention to the full extent indicated by the broad general meaning of the terms used in the claims. The dimensions provided in the description of the lids are tooling dimensions and the actual dimensions of can lids manufactured in accordance with the present invention may be slightly different from the tooling dimensions. The words "extend radially outward", "extend radially inward", "extend radially downward" and "extend radially upward", as used in this document mean that a part or portion extends in the noted direction from another part referred to. It does not, however, necessarily mean that the parts are joined or connected to each other; there could be other parts or portions between the two described portions that are neither shown nor described. When the words "joined" or "connected" are used in this document, they have their normal meanings. The word "up", as used in this document, is used in reference to a can lid as it would be appear when placed on a flat surface with the tab on the face away from the top of the flat surface, such as a can lid would appear when looking down onto the top of a beverage can.

Before describing the present invention, Applicant notes that due to further development of the can lid described and claimed in previous U.S. application Ser. No. 09/456,345, of which the current application is a continuation-in-part, the nomenclature used to describe parts of the lid of the current invention has been changed from that used in the prior application. These changes relate to further development of the chuck and lid designs, particularly with respect to the points of engagement between the chuck and the lid during the seaming process. These changes, detailed below, reflect an accurate description of the parts of the current invention relative to that of the prior application.

In the Ser. No. 09/456,345 application, and specifically referring to FIG. 4 of that application, the chuck 44 was designed to have a driving surface 46 configured to contact and engage with arcuate chuckwall 132 during the seaming process, hence the use of the term "chuckwall" in describing the portion designated as 132. Additionally, the Ser. No. 09/456,345 application disclosed a step portion 34 that extends radially outward from the arcuate chuckwall, a transitional portion 36 that extends radially outward from the step portion, and a peripheral curl portion 38 that extends radially outward from the transitional portion.

As described in detail below, the lid of the current invention has been further developed and modified, primarily with respect to the portion previously referred to as the "chuckwall," and its surrounding portions, and the points of contact for the chuck during seaming. The portion of the lid referred to as the chuckwall 132 in the Ser. No. 09/456,345 application generally corresponds to the portion referred to as arcuate portion 132 in the current invention, although the range of the radius of curvature of these two arcuate portions are not the same. The designation as "chuckwall" has been removed because the chuck 144 of the present invention does not contact or engage with arcuate portion 132 as the chuck 44 contacted the chuckwall 132 in the previous application. The points of contact for the chuck in the current invention are apparent in the detailed description of the drawings below.

Applicant notes that step portion 34 in the Ser. No. 09/456,345 application corresponds to the step portion 134 described herein, with both portions having the same range of radius of curvature. The transitional portion 36 in the Ser. No. 09/456,345 application now consists of two discrete parts in the current invention, generally corresponding to the first transitional portion 136 and the second transitional portion 137. As described below, the first transitional portion 136 is angular relative to the central axis and the second transitional portion 137 has approximately the same ranges for the radius of curvature described for the transitional portion 36 in the previous application. Finally, the peripheral curl portion 38 in the Ser. No. 09/456,345 application generally corresponds to the peripheral curl portion 138 in the current invention, with approximately the same ranges for the radius of curvature for these portions.

Applicant believes that the forgoing clarifies the changes in nomenclature used to describe portions of the present invention relative to related application Ser. No. 09/456,345. The details of the developments, relating to the chuck and lid designs, and particularly the points of engagement between the chuck and the lid during the seaming process, of the invention are described in detail in the following description of the drawings.

FIG. 1 is a cross-sectional view of a portion of a can lid 110, illustrative of the currently preferred embodiment of the present invention. Can lid 110 is preferably made from aluminum sheet metal. Typically, an aluminum alloy is used, such as aluminum alloy 5182. The sheet metal typically has a thickness of from about 0.007 to about 0.010 inches, more preferably from about 0.0075 to about 0.0088 inches, and still more preferably from about 0.0078 to about 0.0083 inches. The sheet metal may be coated with a coating (not shown) on at least one side. This coating is usually provided on that side of the sheet metal that will form the interior of the can. Those skilled in the art will be well acquainted with the methods of forming can lids to provide the general configuration and geometry of the can lid 110 as described herein.

The can lid 110 has a center panel 112. The center panel 112 is generally circular in shape but may be intentionally noncircular. The center panel 112 may have a diameter $d_1$ of from about 1.4 to about 2.0 inches, more preferably from about 1.6 to about 1.8 inches, still more preferably from about 1.65 to about 1.75 inches, and most preferably 1.69 inches. Although the center panel 112 is shown as being flat, it may also have a peaked or domed configuration as well, and is not necessarily limited to the flat or planar configuration shown. The center panel 112 has a central axis 114 that is perpendicular to a diameter $d_2$ of the outer rim, or peripheral curl portion 138, of can lid 110. Diameter $d_2$ is from about 2.25 to 2.50 inches, with a target diameter of 2.34 inches. The diameter $d_1$ of center panel 112 is preferably less than 80% of the diameter $d_2$ of the outer rim.

Surrounding the center panel is an annular countersink 116 that is formed from an interior wall 120 and an exterior wall 128, which are spaced apart and extend radially outward from a curved bottom portion 124. The inner and outer walls 120, 128 are generally flat and may be parallel to one another and to the central axis 114 but either or both may diverge by an angle of about as much as 15°. The annular counter sink 116 extends radially downward from the center panel 112 along the upper edge of the interior wall 120. The curved juncture 118 extending radially inward from interior wall 120 toward the center panel 112 has a radius of curvature $r_1$ that is from about 0.013 to about 0.017 inches, more preferably from about 0.014 to about 0.016 inches, still more preferably from about 0.01475 to about 0.01525 inches, and most preferably 0.015 inches. Bottom portion 124 preferably has a radius of curvature $r_2$. Radius of curvature $r_2$ is from about 0.030 to about 0.060 inches, and still more preferably from about 0.035 to about 0.05 inches, and most preferably about 0.038 inches. The center-point of radius of curvature $r_2$ is located below the profile of can lid 110. The annular countersink 116 has a height $h_1$ of from about 0.03 to about 0.115 inches, more preferably from about 0.05 to about 0.095 inches, and still more preferably from about 0.06 to about 0.085 inches. The bottom portion 124 of annular countersink 116 may also be formed with different inner and outer radii extending radially outward from a flat portion.

The outer wall 128 contains a second chuck contacting portion 228 that is one of two points at which the chuck comes in contact with the interior of the can lid 110 during the seaming operation. An arcuate portion 132 extends radially outward and upward from the outer wall 128 by means of curved juncture 130 having a radius of curvature $r_4$ of from about 0.03 to about 0.07 inches, more preferably from about 0.035 to about 0.06 inches, still more preferably from about 0.0375 to about 0.05 inches, and most preferably about 0.04 inches. The center-point of radius of curvature $r_4$ is located below the profile of can lid 110. The arcuate portion 132 is shown as having a radius of curvature $r_5$ that is from about 0.100 to about 0.300 inches, more preferably from about 0.160 to about 0.220 inches, and still more preferably from about 0.180 to about 0.200 inches. The current design parameter for radius of curvature $r_5$ is 0.0187 inches. The center-point of radius of curvature $r_5$ is located below the profile of can lid 110. The arcuate portion 132 is configured such that a line passing through the innermost end of arcuate portion 132, near the terminus of curved juncture 130, and the outermost end of the arcuate portion 132, near the beginning of step portion 134, forms an acute angle with respect to central axis 114 of the center panel 112. This acute angle is from about 20° to about 80°, and more preferably from about 35° to about 65°, and still more preferably from about 45° to about 55°. The current lid design uses an angle of about 50°.

The step portion 134 extends radially outward from the arcuate portion 132. Step portion 134 is preferably curved with a radius of curvature $r_6$ of from about 0.02 to about 0.06 inches, more preferably from about 0.025 to about 0.055 inches, still more preferably from about 0.03 to about 0.05 inches, and most preferably from about 0.035 to about 0.045 inches. The current lid design parameter for radius of curvature $r_6$ is 0.040 inches. The radius of curvature $r_6$ has a center-point located above the profile of the can lid 110.

Figure 3:
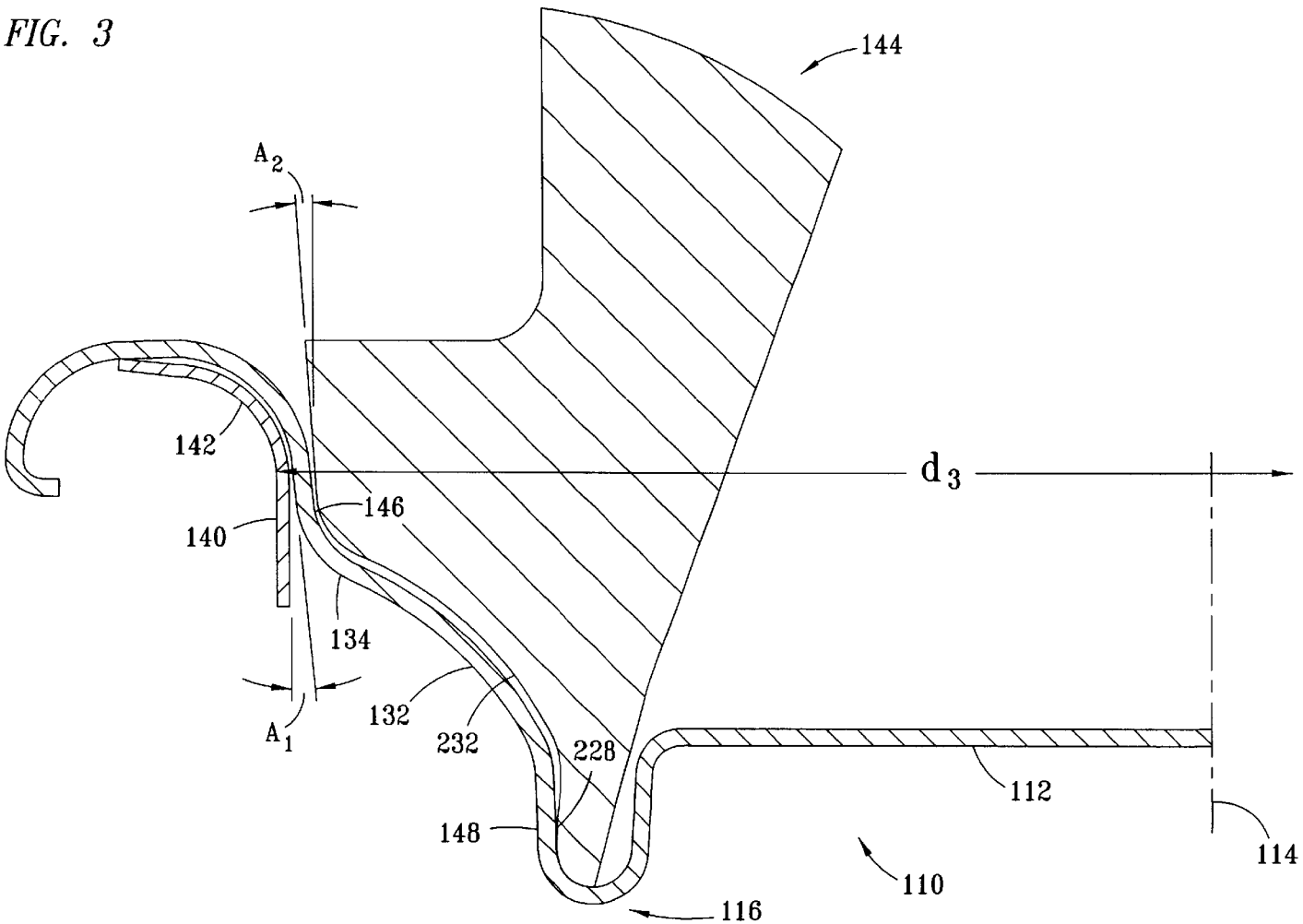
FIG. 3 shows an elevational cross-sectional view of a portion of a can lid on a can body before forming of a double seam.

First transitional portion 136 extends radially upward and slightly outward from step portion 134. First transitional portion 136 forms an angle $A_1$ with respect to central axis 114 of the center panel 112. This angle is from about 4° to about 12°, more preferably from about 5° to about 7°, and most preferably about 6°. As shown in FIG. 3, angle $A_1$ is intended to be slightly larger than angle $A_2$, which is formed by driving surface 146 of chuck 144 with respect to central axis 114 of the center panel 112. Preferably, the difference between angle $A_1$ and angle $A_2$ is no greater than about 4°, and at least about 0.5°. More preferably, the difference between angle $A_1$ and angle $A_2$ is at least about 1°, and not more than about 3. Most preferably, the difference between angle $A_1$ and angle $A_2$ is about 2°. Angle $A_2$ is preferably at least about 2° to aid in removing the can from the chuck 144 after the seaming operation and preferably not greater than about 8°. The current design parameter for angle $A_2$ is about 4°.

Second transitional portion 137 extends radially outward from first transitional portion 136. Second transitional portion 137 has a radius of curvature $r_7$ of from about 0.04 to about 0.09 inches, more preferably from about 0.045 to about 0.08 inches, and still more preferably from about 0.05 to about 0.065 inches. Peripheral curl portion 138 extends radially outward from second transitional portion 137. Peripheral curl portion 138 has a height $h_2$ of from about 0.04 to about 0.09 inches, more preferably from about 0.0475 to about 0.0825 inches, still more preferably from about 0.065 to about 0.0825 inches, and most preferably from about 0.075 to about 0.0825 inches. The current design parameter for height $h_2$ is 0.078 inches.

Figure 2:
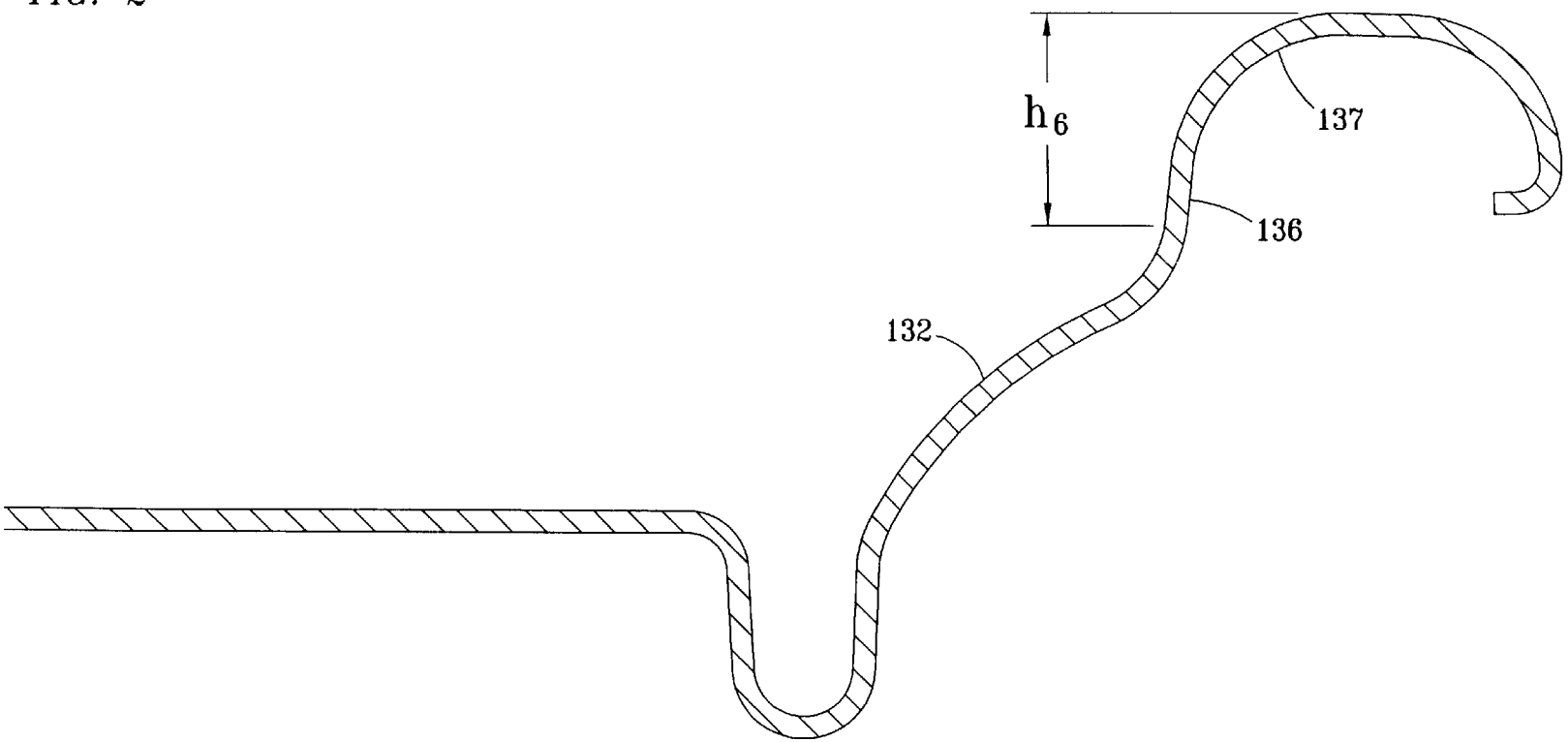
FIG. 2 shows an elevational cross-sectional view of a portion of a can lid constructed in accordance with the invention.

FIG. 2 shows the combined height $h_6$ of the first transitional portion 136 and second transitional portion 137 as being approximately 0.105 inches for the current design parameter. This height is slightly greater than the height of the finished double seam, which is from about 0.096 to about 0.100 inches on the current can design. A reduced seam version of the can has a finished double seam with a height of from about 0.068 to about 0.080 inches, with the height $h_6$ of first transitional portion 136 and second transitional portion 137 being approximately 0.082 inches. A microseam version of the can has a finished double seam with a height of from about 0.050 to about 0.055 inches, with the height $h_6$ of the first transitional portion 136 and second transitional portion 137 being approximately 0.060 inches. The greater height $h_6$ provides an area to generate a finished seam pressure ridge, at the bottom of the double seam, which tightens the final seam and prevents leakage.

FIG. 3 shows can lid 110 resting on can body 140, and particularly resting on flange 142 of can body 140. The radius of the can flange 142 is slightly smaller than the second transitional portion radius $r_7$. Because the flange radius and second transitional portion radius are very similar, the lid easily centralizes on the can for seaming. The can body has an inside neck diameter $d_3$ from about 2.051 to about 2.065 inches, with a target diameter of about 2.058 inches. Can body 140 is supported by a base plate 145 (not shown) which together with chuck 144 is mounted for rotation about axis 114. Chuck 144 includes an upper driving surface 146 configured to match and engage with the surface of step portion 134.

Figure 8:
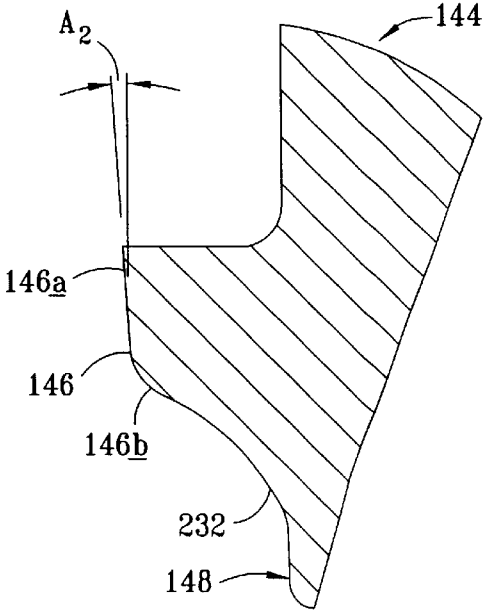
FIG. 8 shows an elevational cross-sectional view of the chuck.

As shown in FIG. 8, upper driving surface 146 is comprised of an upper frustoconical portion 146*a* characterized by angle $A_2$ and a lower curved portion 146*b* characterized by a radius selected to engage with step portion 134 having a radius $r_6$. Chuck 144 also includes a lower driving surface 148 configured to match and engage with the second chuck contacting portion 228 of the annular countersink 116. Recessed portion 232 of the chuck 144 extends between the driving surfaces 146 and 148 and is configured not to contact or deform the arcuate portion 132 of lid 110. The size of the gap between recessed portion 232 and arcuate portion 132 as shown in FIG. 3 is not considered critical and is not shown to scale. Additionally, the approximately 6° angle $A_1$ which first transitional portion 136 forms with respect to central axis 114 of the center panel 112, coupled with the two chuck driving points, the step portion 134, and the second chuck contacting portion 228, further improves the alignment between the chuck 144 and the lid 110. A limited clamping force between chuck 144 and base plate 145 (not shown) provides adequate friction between chuck 144 and step portion 134 and second chuck contacting portion 228 for positive rotation of can lid 110 and can body 140. Because the chuck 144 drives the lid at two points, the step portion 134 and second chuck contacting portion 228, the clamping force required to prevent skidding of the lid during the seaming process is reduced to a range of about 70 to about 140 pounds. This reduction in clamping force reduces the potential for can body sidewall damage during the seaming process. Driving surface 146 of chuck 144 forms an angle $A_2$ that is approximately 4° with respect to central axis 114 of the center panel 112. This angle provides for removing of the can from the chuck 144 after the seaming operation.

Figure 4:
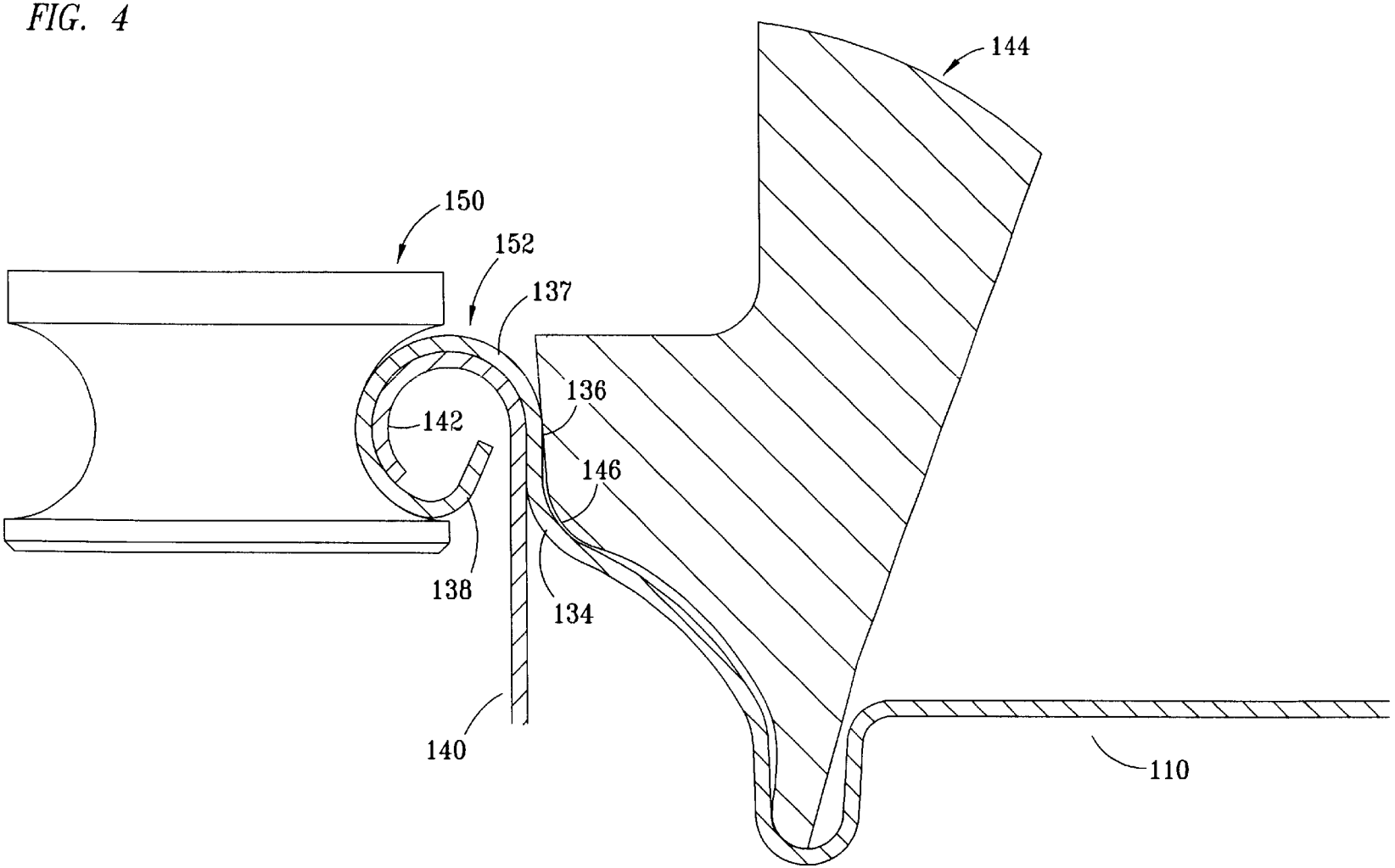
FIG. 4 shows an elevational cross-sectional view of a portion of a can lid on a can body as it appears during the first step of forming a double seam.

FIG. 4 shows the initial stage of double seam formation between can lid 110 and can body 140. Roller 150 bears against peripheral curl portion 138 and the centering force exerted by chuck 144. Chuck 144, using upper driving surface 146 and lower driving surface 148, drives can lid I 10 and can body 140 to rotate, generating a rolling, swaging action that reforms second transitional portion 137, peripheral curl portion 138, and flange 142 into an intermediate peripheral seam 152. Step portion 134 bears against upper driving surface 146 to support second transitional portion 137, and peripheral curl portion 138 leads the rolling deformation against roller 150. Note that there is very little movement of first transitional portion 136 during seaming because it is at nearly the same angle as that of the upper driving surface 146 of chuck 144. When pressure from roller 150 is applied to the peripheral curl portion 138, the second transitional portion 137 is pressed against the chuck 144, further improving the driving of the lid 110. Thus positive support and guidance work together to achieve consistent and reliable results in producing intermediate peripheral seam 152.

Figure 5:
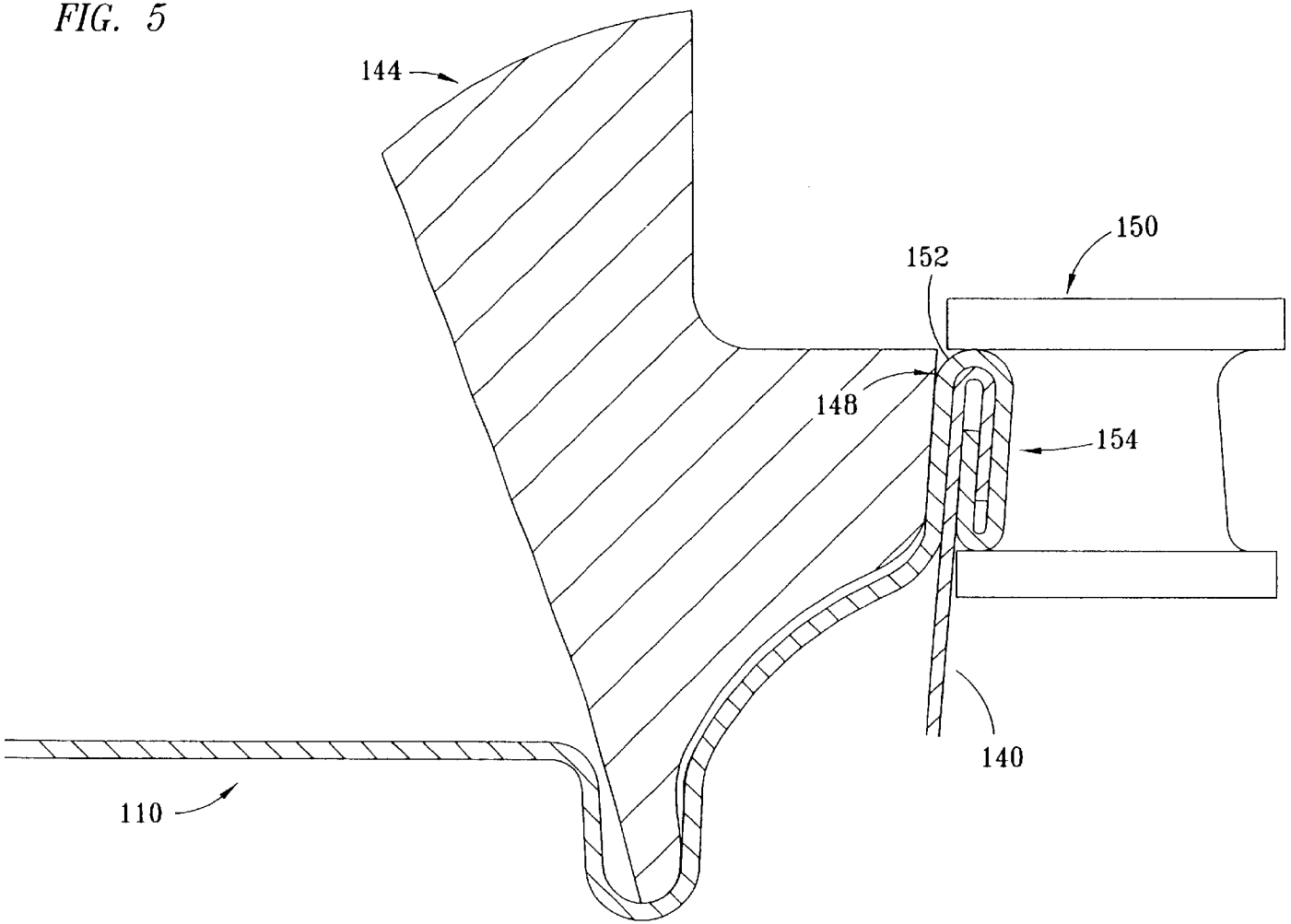
FIG. 5 shows an elevational cross-sectional view of a portion of a can lid on a can body as it appears during the final step of forming a double seam.

FIG. 5 shows the final stage of forming a double seam between can lid 110 and can body 140. Here, roller 150 bears against intermediate peripheral seam 152 as it is supported by chuck 144. Chuck 144 drives can lid 110 and can body 140 to rotate, so that the pressure of roller 150 flattens intermediate peripheral seam 152 against upper portion 148 of chuck 144, producing double seam 154. Upper portion 148 of chuck 144 has a draft angle for ease of separation of can lid 110 after this operation.

Figure 6:
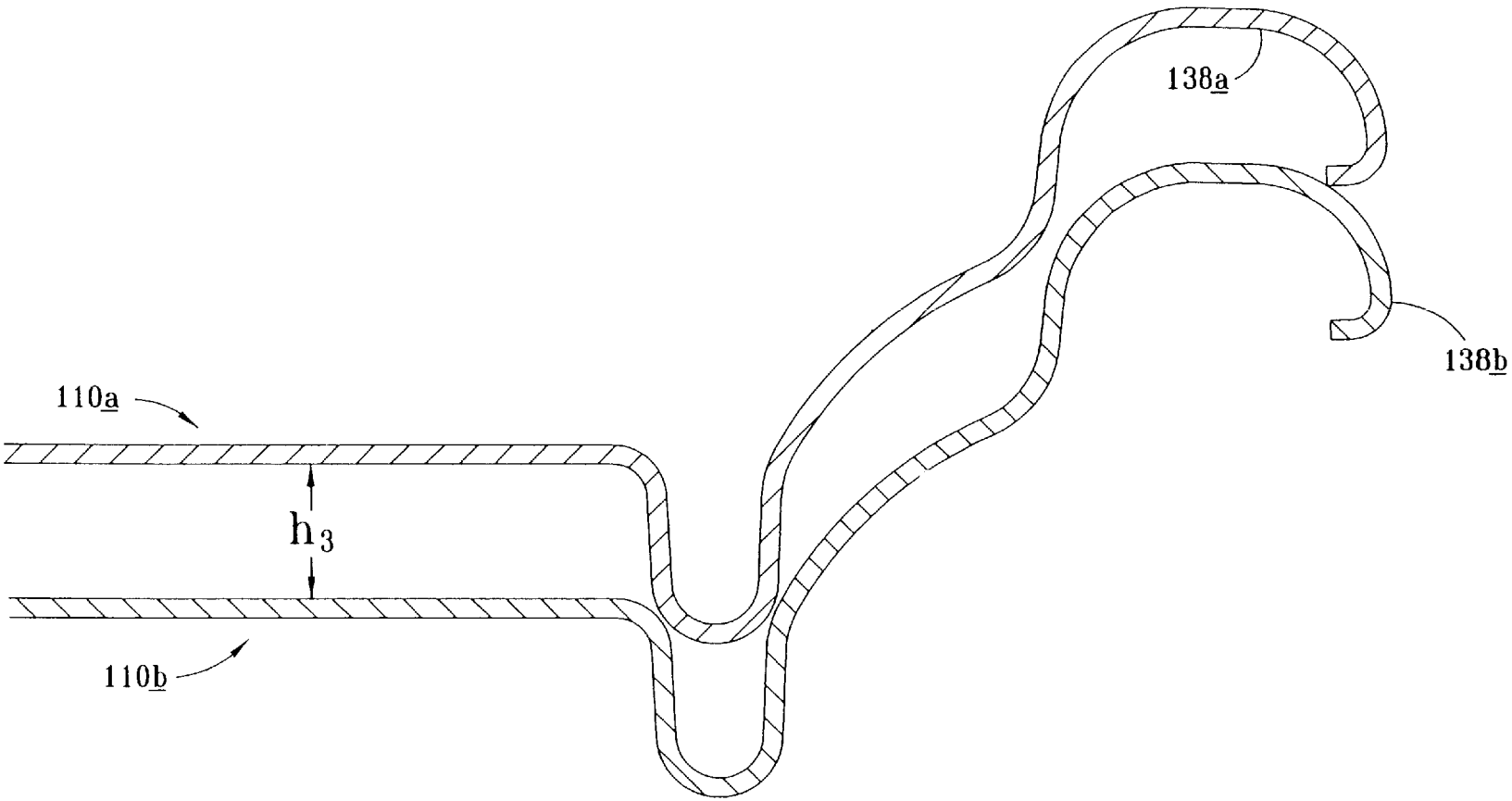
FIG. 6 shows an elevational cross-sectional view of the manner of stacking can lids prior to seaming constructed in accordance with the invention.

FIG. 6 shows the manner in which a plurality of can lids 110*a* and 110*b* stack for handling, packaging, and feeding a seaming machine. Underside of peripheral curl 138*a* bears down against upper portion of peripheral curl 138*b* of adjacent can lid 110*b*. Can lid 110*a* is supported and separated from can lid 110*b* by a height $h_3$ sufficient to accommodate the thickness of a pull-tab (not shown). In this manner, can lids 110 are compactly and efficiently handled and are more readily positioned for magazine feeding of a mechanized seaming operation.

Figure 7:
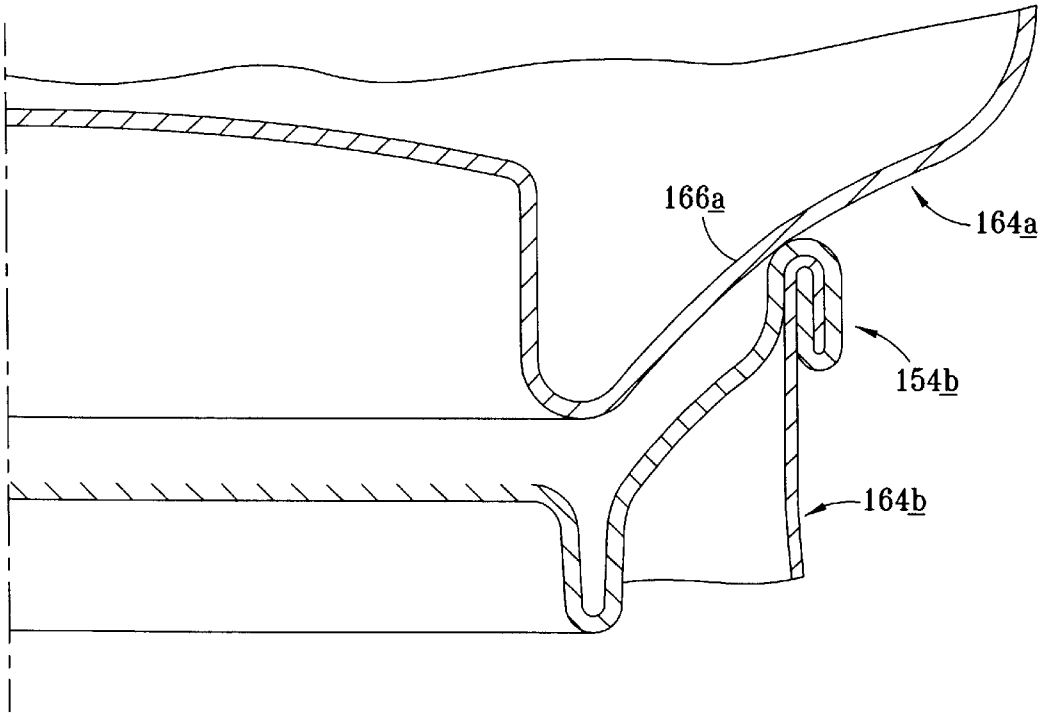
FIG. 7 shows an elevational cross-sectional view of the manner of stacking filled cans of the present invention.

FIG. 7 shows the manner of stacking filled can 164*a*, closed and sealed according to the present invention on a like filled can 164*b*. Stand bead 166*a* rests upon double seam 154*b*.

FIG. 8 shows those portions of the chuck 144 shown in FIG. 3, and described above, and also provides a more detailed view of the upper frustoconical portion 146*a* and lower curved portion 146*b* of the upper driving surface 146.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present invention have been described in the drawings and accompanying text, the description is illustrative only, and changes may be made in the detail, especially in matters of shape, size, and arrangement of the parts within the principles of the invention to the full extent indicated by the broad meaning of the terms of the attached claims.

The restrictive description and drawings of the specific examples above do not point out what an infringement of this patent would be, but are to provide at least one explanation of how to use and make the invention. The limits of the invention and the bounds of the patent protection are measured by and defined in the following claims.

We claim:

1. A method of forming a double seam joining a can body to a can lid, the can lid having a center panel having a central axis that is perpendicular to a diameter of the outer rim of said lid, an annular countersink portion extending radially outward from said center panel, an arcuate portion extending radially outward from the annular countersink wherein a line passing through the ends of said arcuate portion is at an angle with respect to said central axis of the center panel of from about 20° to about 80°, a step portion extending radially outward from the arcuate portion, a first transitional portion extending radially outward from said step portion, a second transitional portion extending radially outward from the first transitional portion to a peripheral curl, and the can body having a can body flange, comprising the steps of:

supporting the can body on a base plate;

positioning the can lid on the can body with the second transitional portion resting on the can body flange;

providing a chuck having a lower portion, an upper portion, and a recessed portion extending between the lower portion and the upper portion, the upper portion of the chuck having a frustoconical portion and a driving surface that is configured to contact the step portion of the lid, the recessed portion of the chuck being configured not to deform said arcuate portion of said can lid during forming of the seam, and the lower portion of the chuck configured to contact a surface of said annular countersink at a chuck contacting portion when the chuck is in engagement with the can lid;

engaging the can lid with the chuck;

rotating the can and lid assembly using the chuck; rolling the peripheral curl and can body flange together to form an intermediate peripheral seam; and compressing the intermediate peripheral seam against the upper portion of the chuck to form a double seam.

2. The forming method according to claim 1 wherein said frustoconical portion of said upper portion of said chuck is inclined at an angle with respect to said central axis of 4°.

3.The forming method according to claim 1 wherein said frustoconical portion of said upper portion of said chuck is inclined at an angle with respect to said central axis of greater than 2°, said angle being not more than 3° less than the angle formed by said first transitional portion of said lid with respect to said central axis of said center panel.

4. The forming method according to claim 1 wherein a clamping force of 70 to 140 pounds is applied to the chuck and the base plate when rotating the can and lid assembly.

5. A method of forming a double seam joining a can body to a can lid, the method comprising:

supporting the can body on a base plate;

positioning the can lid having a center panel, an annular countersink, a chuckwall having one or more portions, and a peripheral curl on the can body flange providing a chuck having a lower contact portion configured to contact a portion of the outer wall of the annular countersink, an upper contact portion configured to contact a portion of the chuckwall of the can lid, and a recessed portion extending between the lower contact portion and the upper contact portions the recessed portion of the chuck being configured not to deform the portions of the can lid chuckwall not contacted by the chuck during forming of the seam;

engaging the can lid with the chuck;

rotating the can and lid assembly using the chuck; rolling the peripheral curl and can body flange together to form an intermediate peripheral seam; and compressing the intermediate peripheral seam against the upper portion of the chuck to form a double seam.

6. The forming method according to claim 1 wherein a clamping force of 70 to 140 pounds is applied to the chuck and the base plate when rotating the can and lid assembly.

* * * * *

UNITED STATES PATENT AND TRADEMARK OFFICE

CERTIFICATE OF CORRECTION

PATENT NO. : 6,561,004 B1
DATED : May 13, 2003
INVENTOR(S) : Neiner et al.

It is certified that error appears in the above-identified patent and that said Letters Patent is hereby corrected as shown below:

Title page,
Item [56], References Cited, OTHER PUBLICATIONS please add the following references:
-- WO 96/37414; International Application published by the World Intellectual Property Organization; November 28, 1996; PCT/GB96/00709; Caranaudmetalbox plc; Great Britain.

WO 98/34743; International Application published by the World Intellectual Property Organization; August 13, 1998; PCT/GB98/00243; Crown Cork & Seal Technologies Corporation; United States --

Column 3,
Line 28, please delete "and".
Line 30, please delete "." and add -- ; and -- to the end of the sentence.

Column 7,
Line 14, please delete "can body has" and insert therefor -- can body 140 has --.
Lines 57- 58, please delete "can lid 1 10 " and insert therefor -- can lid 110 --.

Column 10,
Lines 4-25, please delete Claim 5 in its entirety and insert therefor:
-- A method of forming a double seam joining a can body to a can lid, the method comprising: supporting the can body on a base plate;

positioning the can lid having a center panel, an annular countersink, a chuckwall having one or more portions, and a peripheral curl on the can body flange;

providing a chuck having a lower contact portion configured to contact a portion of the outer wall of the annular countersink, an upper contact portion configured to contact a portion of the chuckwall of the can lid, and a recessed portion extending between the lower contact portion and the upper contact portion, the recessed portion of the chuck being configured not to deform the portions of the can lid chuckwall not contacted by the chuck during forming of the seam;

engaging the can lid with the chuck;

rotating the can and lid assembly using the chuck;

UNITED STATES PATENT AND TRADEMARK OFFICE

CERTIFICATE OF CORRECTION

PATENT NO. : 6,561,004 B1
DATED : May 13, 2003
INVENTOR(S) : Neiner et al.

It is certified that error appears in the above-identified patent and that said Letters Patent is hereby corrected as shown below:

Column 10 (cont'd), rolling the peripheral curl and can body flange together to form an intermediate peripheral seam; and compressing the intermediate peripheral seam against the upper portion of the chuck to form a double seam. --

Signed and Sealed this

Third Day of February, 2004

JON W. DUDAS
*Acting Director of the United States Patent and Trademark Office*